United States Patent [19]

Karlskind

[11] 4,073,562

[45] Feb. 14, 1978

[54] WET CONNECTOR

[75] Inventor: Neil Karlskind, Chatsworth, Calif.

[73] Assignee: Gray Tool Company, Houston, Tex.

[21] Appl. No.: 718,473

[22] Filed: Aug. 30, 1976

[51] Int. Cl.[2] ..... H01R 13/52; H01R 13/54

[52] U.S. Cl. ..... 339/117 P; 339/12 V

[58] Field of Search ..... 339/117 R, 117 P, 118 R, 339/12 V, 42, 60 M, 96

[56] References Cited

U.S. PATENT DOCUMENTS 3,508,188 4/1970 Buck ..... 339/117 R X

*Primary Examiner*—Roy Lake
*Assistant Examiner*—DeWalden W. Jones
*Attorney, Agent, or Firm*—Cushman, Darby & Cushman

[57] ABSTRACT

To mate two complementary insulated electrical connectors while they are bathed in an electrically conductive medium, such as sea water, the two are first brought into mechanical contact with their respective matable electrical parts presented in axial alignment across a chamber defined therebetween. A non-conductive fluid is pumped under pressure through the chamber to flush electrically conductive medium and possible contaminants therefrom. Then an axial force is applied to the matable electrical part of one connector, forcing it axially across the chamber and into mating relation with the matable electrical part of the other connector. By preference, the matable electrical parts are pins and sockets and the interfacial chamber is flushed via ported bores in the sockets, using compressed air or a thick fluid such as hydraulic oil, transformer oil or polybutene. A typical use is to make and break an electrical connection for an electrically operated subsea oil wellhead flow control device.

13 Claims, 4 Drawing Figures

210
218
220
220
298
224
286
228
222
232
244
242
274
350
352
354
66
116
42
68
70
72
64
48

WET CONNECTOR

BACKGROUND OF THE INVENTION

The possible uses for electrical connectors which can be made-up and separated underwater are about as varied and limitless as possible uses on land. Fields which come immediately to mind are underwater petroleum wells; subsea mining and mineral recovery; underwater welding; penstock, caisson, tunnel and dam construction; waterway and vessel repair; connection of vessels to one another or to fixed structures such as deepwater tank farm buoys.

There are additional possible uses in non-submerged, yet wet environments ranging from ship decks to automatic car washes and automated low seam deep mining of coal where the intrusion of water between connectors being made up can cause short circuits, electrical fires, equipment failure, explosions and other hazardous events.

Heretofore, most electrical connections needed underwater and in other wet environments have been made up and hermetically sealed while dry. Repeated disconnection and reconnection requires recovery of the whole connection from the wet environment; make-up and separation in the wet environment are not possible.

One existing partial solution is to provide a dry work chamber and to make and break the connection only within the dry work chamber. This technique obviously has limited applicability.

Another partial solution is the use of elaborate sealing arrangements for each connector half, coupled with the use of divers to manipulate the connector halves and sealing arrangements as the connector is made-up and separated underwater. The use of this technique is limited by the expense of divers and the lack of good diving weather alot of places too much of the time.

During the preparation of this description, a search of already issued United States patents was conducted which produced the following collection:

| Patentee | Patent No. | Issue Date |
|---|---|---|
| McLoad | 3,324,449 | June 6, 1967 |
| Wofford | 3,593,415 | July 20, 1971 |
| Elkins | 3,665,509 | May 23, 1972 |
| Burkhardt et al. | 3,714,384 | Januaary 30, 1973 |
| Briggs et al. | 3,729,699 | April 24, 1973 |
| Webb | 3,772,636 | November 13, 1973 |
| De Vries | 3,839,608 | October 1, 1974 |

SUMMARY OF THE INVENTION

The present invention provides a wet connector, that is an electrical connector that can be made-up and separated while in a wet environment, yet which will provide the assurance that the wetness, contaminant or other electrically conductive nuisance is purged from the interface of the connector members in the course of establishing the connection. The purging is controlled remotely and provision is made for remotely controlled separation of the electrical connection.

To mate two complementary insulated electrical connectors while they are bathed in an electrically conductive medium, such as sea water, the two are first brought into mechanical contact with their respective matable electrical parts presented in axial alignment across a chamber defined therebetween. A non-conductive fluid is pumped under pressure through the chamber to flush electrically conductive medium and possible contaminants therefrom. Then an axial force is applied to the matable electrical part of one connector, forcing it axially across the chamber and into mating relation with the matable electrical part of the other connector. By preference, the matable electrical parts are pins and sockets and the interfacial chamber is flushed via ported bores in the sockets, using compressed air or thick fluid such as hydraulic oil, transformer oil or polybutene. A typical use is to make and break an electrical connection for an electrically operated subsea oil wellhead flow control device.

The principles of the invention will be further discussed with reference to the drawing wherein preferred embodiments are shown. The specifics illustrated in the drawing is intended to exemplify, rather than limit, aspects of the invention as defined in the claims.

DETAILED DESCRIPTION OF THE PRESENTLY PREFERRED EMBODIMENTS

Figure 1:
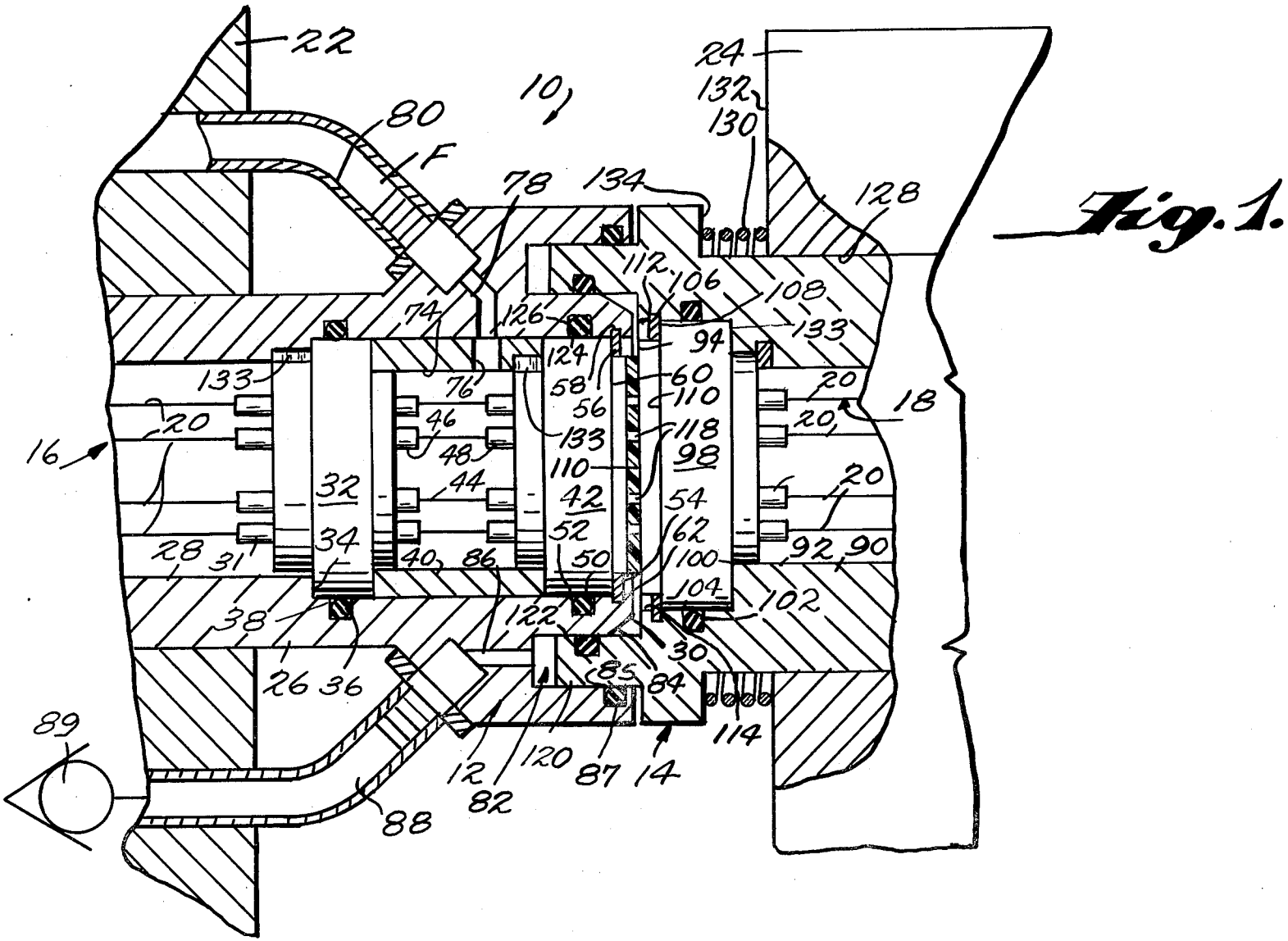
FIG. 1 is a longitudinal sectional view of a wet connector constructed in accordance with a first embodiment of the invention. The connector is shown in a fully mated condition.

The connector 10 includes two matable connector parts 12, 14 at respective terminii of electrical cables 16, 18. In the instance depicted, the cables 16, 18 are made-up of a plurality of individual conductors 20, for example fifty 16 A.W.G. conductors. The connector parts 12, 14 are shown mounted on respective items of equipment 22, 24 such as an underwater wellhead and a hydraulic connector. However it is neither essential to use of the connector 10 that have multi-conductor cables or be mounted on other items of equipment.

The first connector part 12 includes a first tubular housing 26 having a throughbore 28 in which the electrical cable 16 extends. Near the end 30 of the housing 26, the conductors 20 of the cable 16 are terminated in the respective solder cups 31 of a fitting 32 which is seated against a shoulder 34 in the bore 28. An O-ring 36 in a circumferential groove 38 seals between the fitting 32 and the bore 28. A tubular spacer 40 is coaxially received in the bore against the outer end of the fitting 32 and a socket insert 42 is coaxially received in the bore 28 against the outer end of the spacer 40. Extensions 44 of the respective conductors 20 of the cable 16 extend axially through the spacer 40 and are conected between confronting respective solder cups 46, 48 of the fitting 32 and socket insert 42.

(The fitting 32, spacer 40 and extensions 44 are provided for manufacturing convenience. These parts could be eliminated and the respective conductors 20 of the cable 16 terminated in the solder cups 48 of the socket insert 42 instead.)

An O-ring 50 in a circumferential groove 52 seals between the socket insert 42 and the bore 28. A snap ring 54 seated against a shoulder 56 at the radially outer margin of the outer end 60 of the socket insert 42 and received in a circumferential groove 58 in the bore 28 retains the socket insert firmly in place at the end of the bore 28 with the outer end 60 of the socket insert facing out of the mouth 62 of the bore 28.

Figures 3, 4:
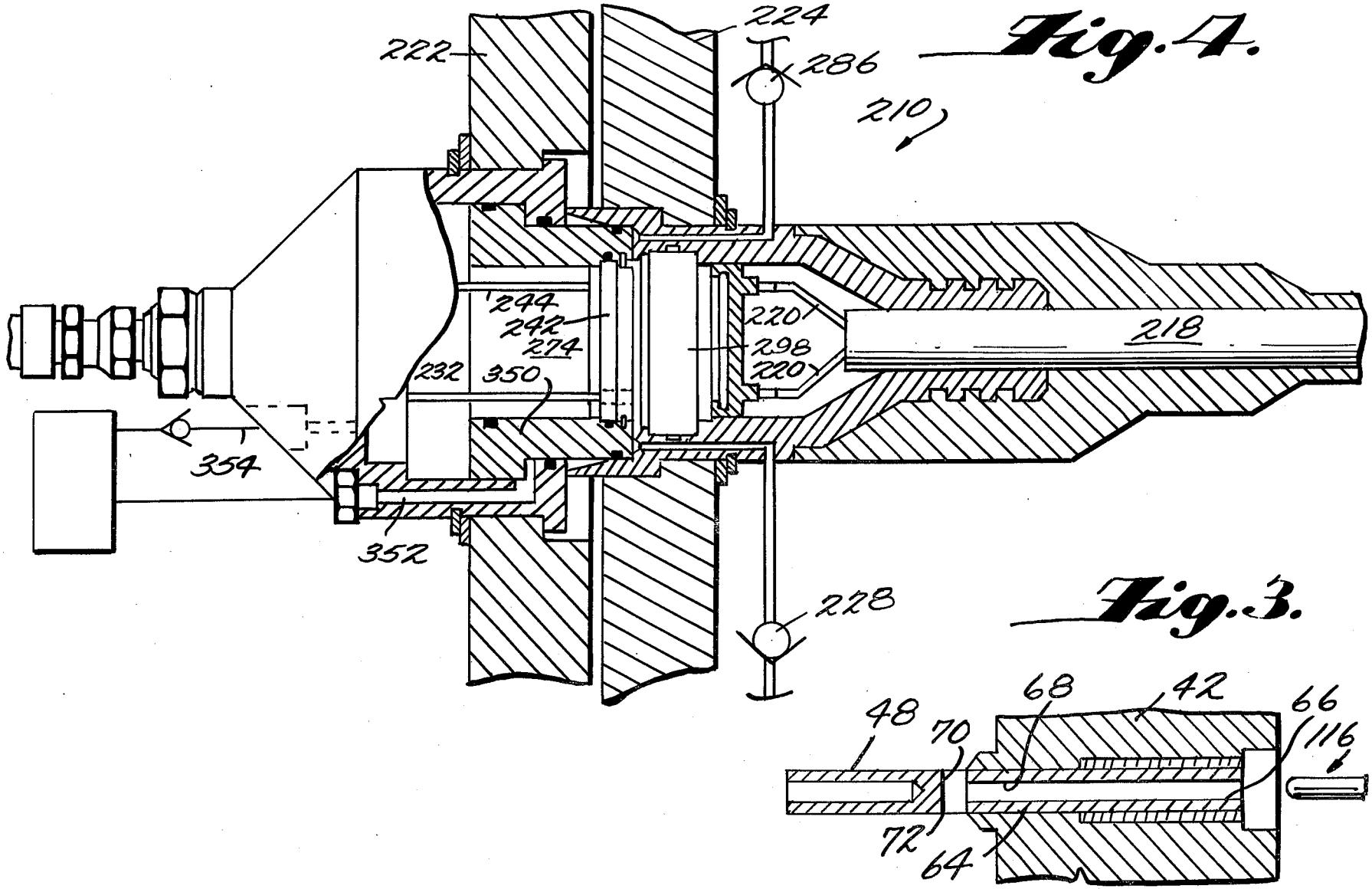
FIG. 3 is a longitudinal sectional view of one typical socket and pin.
FIG. 4 is a longitudinal sectional view similar to FIG. 1, but of a second embodiment.

As shows best in FIG. 3, the solder cups 48 of the socket insert 42 are provided in the rear ends of respective individual socket elements 64. Each socket element 64 is a rod-shaped member with a solder cup 48 opening through one end and a socket 66 provided as a well, opening out through the opposite end. A conduit 68 extends axially inwards some distance from an origination at the inner end of the socket well then turns radially outwards at 70 (without intersecting the solder cup) and communicates through the outer surface of the element 64 at an inlet end 72.

The socket elements 64 are arranged in an array of transversally spaced apart, parallel elements longitudinally aligned with and mounted in socket insert 42. The mounting may be accomplished by molding a body of electrically insulating material about the array of socket elements and fabricating this composite into a socket insert. Notice that the socket elements each have the socket well thereof open through the outer end 60 of the socket insert 42 and the conduit 68 inlet 72 communicates behind the socket insert 42 with the bore 74 within the spacer 40.

Between the O-ring seals 36 and 50, a radial opening 76 is provided through the spacer 40 and a conduit 78 formed through the housing 26 communicates with the opening 76. A supply pipe 80 for pressurized fluid is connected to the conduit 78.

Radially outwardly beyond the bore mouth 62, a groove 82 is coaxially formed in the same end of the housing 26. As depicted, the groove 82 is of generally U-shaped longitudinal section, with its radially inner leg chamfered to a substantial depth to provide a relief 84. A circumferential groove 85 facing radially inwards is provided in the radially outer let of the groove 82 near the groove mouth and receives an O-ring 87. From the base of the groove 82, a conduit 86 is formed in the housing 26. A drain pipe 88 is connected to the conduit 86 and provided with an anit-backflow check valve 89.

The second connector part 14 includes a second tubular housing 90 having a throughbore 92 in which the electrical cable 18 extends. Near the outer end 94 of the housing 90, the conductors 20 of the cable 18 are terminated in the respective solder cups 96 of a pin insert 98 which is seated against a shoulder 100 in the bore 92. An O-ring 102 in a circumferential groove 104 seals between the pin insert 98 and the bore 92. A snap ring 106 seated against a shoulder 108 at the radially outer margin of the outer end 110 of the pin insert 98 and received in a circumferential groove 112 in the bore 92 retains the pin insert firmly in place at the end of the bore 92 with the outer end of the pin insert facing out of the mouth 114 of the bore 92.

As shows best in FIG. 3, the solder cups 96 of the pin insert 98 are provided in the rear ends of respective individual pin elements 116. Each pin element 116 is a rod-shaped member with a solder cup 96 opening through one end and a pin 118 provided as an axial projection at the opposite end.

The pins 118 are sized to slide longitudinally into the socket wells 66 of the respective socket elements 64, and to make sound electrical contact therewith. Accordingly, the pin elements 116 are arranged in an array of transversally spaced apart, parallel elements longitudinally aligned with and mounted in the pin insert 98. The array of pin elements matches the array of socket elements, in the sense that when the pin insert and socket insert are brought into confrontation, there is a socket well 66 dead ahead of each pin element. The mounting of the pin elements in the pin insert may be accomplished by molding a body of electrically insulating material about the array of pin elements and fabricating this composite into a pin insert. Notice that the pin elements 116 each have the pin 118 thereof projection forwards from the outer end surface 110 of the pin insert.

Radially outwardly beyond the bore mouth 114, a tubular flange 120 is provided as an coaxial projection on the same end of the housing 90. The flange 120 is sized and located to be substantially fully received in the U-shaped groove 82 of the housing 26 when the connector parts 12, 14 are mated. The radially inner surface 122 of the flange 120 is provided with a radially inwardly opening circumferential groove 124 which receives an O-ring 126. The groove 124 is so positioned along the length of the surface 122, that when the flange 120 is fully received in the groove 82, the O-ring 126 seals with the radially inner leg of the groove 82, axially just beyond the base of the relief 84. The O-ring 87 forms a seal with the radially outer surface of the flange 120 near the base of the flange 120. It should be apparent that as the housings 26 and 90 are moved axially apart, and the flange 120 begins corresponding withdrawal from the groove 82, the O-ring 126 loses sealing contact when it is radially aligned with the relief 84, yet the O-ring 87 remains sealed with the flange 120.

The item of equipment 24 on which the connector part 14 is mounted has a bore 128 in which the housing 90 is longitudinally slidingly received for limited axial excursion. A compression coil spring 130 coaxially surrounds the housing 90 where it emerges from the bore 128. One end of the spring 130 engages the end 132 of the equipment 24 and the other engages a rearwardly facing circumferential shoulder 134 on the housing 90. Accordingly, when the items of equipment 22, 24 are fixed in juxtaposition to one another, in the relation depicted in FIG. 1, the connector part 14 can be retracted away from the connector part 12 into the bore 128 against the spring force, until the spring coils are fully condensed, (see FIG. 2), and the connector part 14 can extend towards the connector part until the spring force is largely expended and the connector parts 12, 14 are fully mated (FIG. 1).

Figure 2:
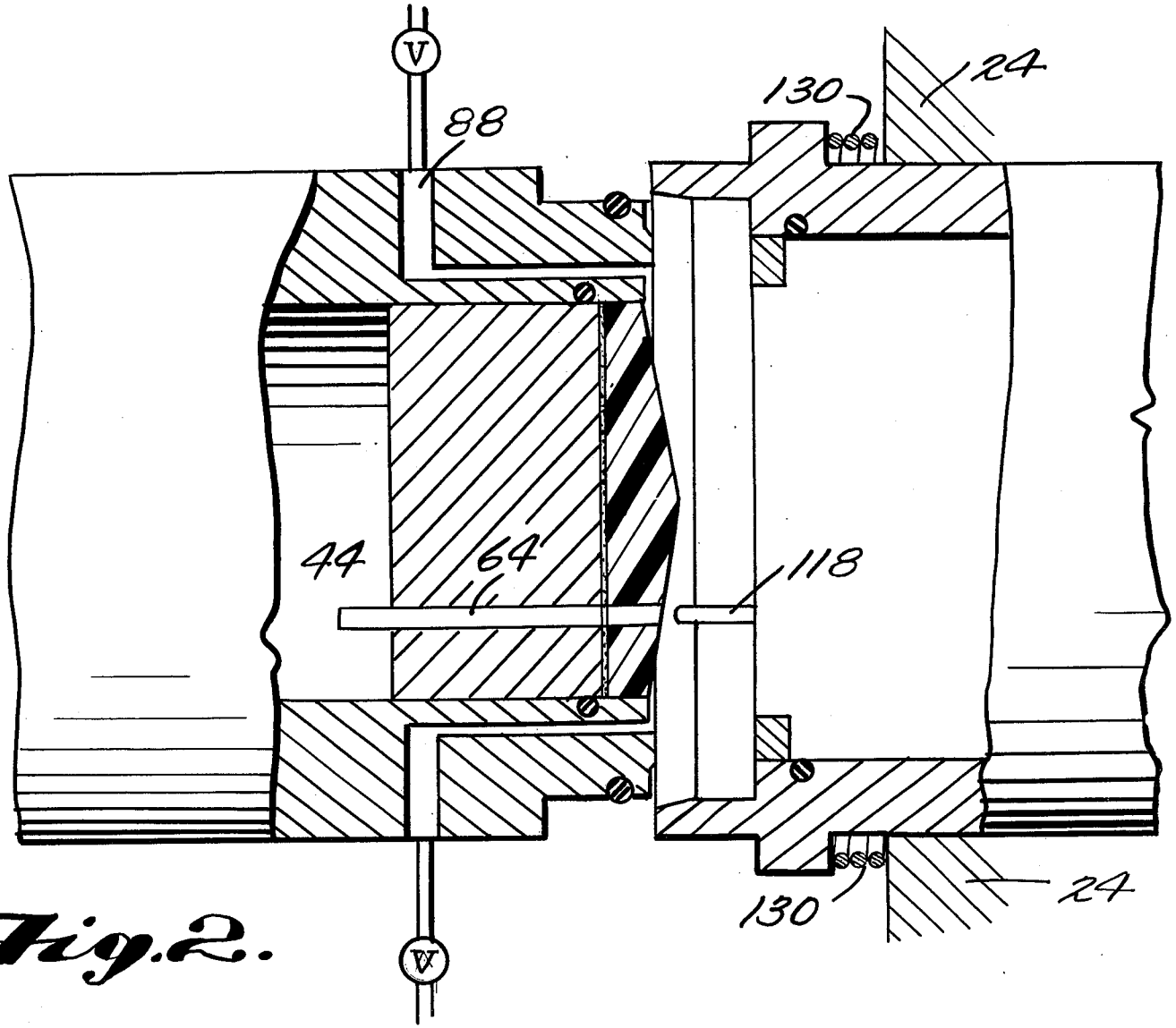
FIG. 2 is a longitudinal sectional view of the wet connector of FIG. 1, shown during the purging sequence.

The embodiment of FIGS. 1–3 is typically used as follows. Assume one of the connector parts 12 or 14 is already mounted on an item of equipment 22 or 24 that is located underwater. The other connector part is mounted on the other item of equipment and lowered to the vicinity of the already submerged connector part and the two connector parts are brought into axial alignment with the pin array confronting the socket array and corresponding pins confronting corresponding sockets.

(Various techniques for carrying out this maneuver are well known in the underwater petroleum well drilling and completion art. For instance, axial alignment can be achieved using a guideline system between the parts 12 and 14 or between the items 22 and 24, in the manner described in the U.S. Pat. No. 3,313,347 of Crain, issued Apr. 11, 1967 and angular alignment can be achieved using an alignment arrangement between the parts 12 and 14 or between the items 22 and 24, in the manner described in the U.S. Pat. No. 3,536,342 of Hull et al., issued Oct. 27, 1970. These alignment techniques are merely exempliary; others are known and possible, for instance ones based on use of underwater television cameras, acoustic transponders and other remote sensing devices.)

Key and Keyway arrangements 133 are provided between the respective inserts and conductor parts to predetermine the relative angular positions of these members.

With the parts 12 and 14 in confronting alignment, one item 22 or 24 is moved toward the other until the tubular flange 120 is received in the groove 82. This may be referred to as first stage mating or mechanical mating. Whether the pins 118 slide into the sockets 66 at this stage is not material. At this stage, the items of equipment 22, 24 are secured in relation to one another by conventional means not shown.

Then, a pressurized fluid F less electrically conductive than sea water is pumped through the supply pipe 80, conduit 78, opening 76 and into the bore 74 behind the socket insert 74. The pressure exerted on the fluid by the pumping means (not shown), causes the fluid F to enter the inlets 72, flow along the conduits 68, emerge out of the socket wells and flow into the interfacial chamber defined between the confronting end surfaces of the pin insert and socket insert. This pressure then causes the pin insert and the connector part 14 to back away from the connector part 12 (FIG. 2), until the spring 130 is fully condensed. At this point, the O-ring 126 has lost sealing engagement with the radially inner leg of the groove 82 and the fluid F begins to escape between the seal 126 and the relief 84. However, the seal at 87 remains in sealing engagement, so the escaping fluid passes out the drain pipe 88. As the pumping of fluid F is continued, sea water, mud or other contaminants in and around the socket insert and in the interfacial chamber are flushed out and carried away with the escaping fluid F. When the human operators believe the flushing has removed the sea water and contaminants, pumping is terminated, whereupon the recovering spring 130 extends the connector part 14 back to its FIG. 1 position and the pins 118 home in the sockets 66. This may be referred to as second stage or electrical mating.

Before full electrical power is applied to the connector 10, lesser current may be applied to any individual pairs of the conductors 20, or to pairs reserved for test purposes, and electrical resistance measurements taken. Any variations from expected valves may indicate some moisture or other short-causing contaminant remains in the connector. In that case further flushing and retesting are conducted.

When one of the items of equipment and its associated connector part are to be recovered from underwater, the electric power is cut off, and the flushing operation is reinitiated to disconnect the pins from the sockets while the pins are in a withdrawn state, the items 22 and 24 can be unsecured relative to one another and the desired item and associated connector part recovered to the surface.

A modified wet connector construction 210 is shown in FIG. 4, in which parts corresponding to those of the first described embodiment are given like numerals, but raised by 200.

These are the most noteworthy differences in the FIG. 4 construction, (A) It is the socket insert, rather than the pin insert that is axially movable relative to its connector part;

(B) The socket insert is mounted on a piston and pressurized fluid can be applied to both sides of the piston to move it in either desired axial direction, instead of using pressurized fluid for movement in one direction and spring force for movement in the opposite direction;

(C) When the connector parts are electrically mated, the piston blocks the drain and the elastomeric interface is preferably omitted as surplusage.

In FIG. 4, the piston 350 mounts the socket insert 242. When pressurized fluid is applied through the conduit 352 and pressure is released on the conduit 354, the piston 350 retracts the socket insert axially away from the pin insert. Then, if pressure is maintained in the conduit 352 and some but less pressure is applied to the conduit 354, fluid will flow therefrom into the chamber behind the socket insert, flow through the socket elements as described in relation to FIG. 3, and displace water and debris from the interfacial region between the pin and socket inserts. The displaced material and some of the displacing fluid acting as a flush, flow out through the drains 286,288. When flushing is completed, pressure in the conduit 354 is increased as pressure on the conduit 352 is released, causing the piston 350 to move forward, mating the pins with the respective sockets. Notice that as to the conduit 354, the fluid which powers the piston is the same fluid as that which flushes the sockets and interfacial region.

It should now be apparent that the wet connector as described hereinabove, possesses each of the attributes set forth in the specification under the heading "Summary of the Invention" hereinbefore. Because the wet connector can be modified to some extent without departing from the principles of the invention as they have been outlined and explained in this specification, the present invention should be understood as encompassing all such modifications as are within the spirit and scope of the following claims.

What is claimed is:

1. A method for mating two complementary insulated electrical connectors while they are bathed in an electrically conductive medium such as sea water, comprising:

bringing the two connectors into mechanical contact, with their respective matable electrical parts presented in axial alignment across a sealed chamber that is defined between said parts as mechanical contact is accomplished;

pumping an electrically non-conductive fluid under pressure through the chamber to flush electrically conductive medium and any debris therefrom; and applying an axial force to the matable electrical part of one connector to force that part axially across the chamber and into mating relation with the matable electrical part of the other connector.

2. The method of claim 1, wherein:

the two electrical parts respectively comprise a pin and a socket for the pin; wherein in the flushing step the electrically non-conductive fluid is pumped through the socket into the chamber; and wherein the two electrical parts mate by reception of the pin in the socket.

3. The method of claim 1, wherein:

the electrically non-conductive fluid is hydraulic fluid.

4. the method of claim 1, wherein:

the electrically non-conductive fluid is electrical transformer oil.

5. The method of claim 1, wherein:

the electrically non-conductive fluid is polybutene.

6. The method of claim 1, wherein:

the electrically non-conductive fluid is air.

7. The method of claim 1, wherein:

in the pumping step, the matable electrical part of said one connector is forced axially away from the other matable electrical part by the electrically non-conductive fluid, against a spring thereby compressing the spring; and in the step of applying an axial force, the chamber is permitted to drain, said pumping is reduced and the compressed spring recovers thereby applying said axial force.

8. The method of claim 1, wherein:

prior to the pumping step, the matable electrical part of said one connector is forced axially away from the other matable electrical part and held away while the pumping step is conducted, then the holding step is terminated, the chamber is permitted to drain and the electrically non-conductive fluid is applied against the rear of the matable electrical part of said one connector to carry out the axial force applying step.

9. A Wet connector, comprising:

two complementary insulated electrical connectors having respective matable electrical parts;

tubular means surrounding the respective electrical parts and having respective circumferential sealing means; the tubular means of one connector being sealingly engageable with the tubular means of the other connector with the aid of said sealing means, irrespective of whether the respective matable electrical parts are mated, to define a generally cylindrical chamber having the respective matable electrical parts in confrontation at axially opposite ends of the chamber;

means defining a fluid drain conduit from the chamber;

means mounting one of the matable electrical parts in the respective tubular means for axial movement between a retracted position wherein the two matable electrical parts are unmated, and an extended position wherein the two matable electrical parts are mated;

conduit means extending into one of the tubular means behind, the respective matable electrical part; and an opening through the last-mentioned matable electrical part for communicating the last-mentioned tubular means, behind the respective matable electrical part with the chamber for the supply of electrically non-conductive rinsing fluid thereto;

said one tubular means being the one surrounding the movably mounted one of the matable electrical parts;

a slidable piston being provided in said one tubular means, the last-mentioned matable electrical part being secured to the slidable piston;

means for applying force to one side of the piston when desired, for axially moving the piston and the one matable electrical part axially away from the other matable electrical part and for maintaining this force to keep the piston retracted;

whereby, when the piston and the one matable electrical part are moved axially away from the other matable electrical part and kept retracted, electrically non-conductive fluid may be introduced under pressure through said conduit means and said opening, into said chamber and out said drain conduit to flush electrically conductive fluid such as sea water, and debris, from the chamber and when said force that is being maintained is reduced, but the electrically non-conductive fluid still introduced under pressure through said conduit means into the respective tubular part behind the piston, the piston will extend mating the one matable electrical part with the other matable electrical part.

10. The wet connector of claim 9, wherein:

the one matable electrical part comprises at least one socket; and the other matable electrical part comprises at least one pin, axially removably receivable in said socket.

11. A wet connector, comprising:

two complementary insulated electrical connectors having respective matable electrical parts;

tubular means surrounding the respective electrical parts and having respective circumferential sealing means; the tubular means of one connector being sealingly engageable with the tubular means of the other connector with the aid of said sealing means, irrespective of whether the respective matable electrical parts are mated, to define a generally cylindrical chamber having the respective matable electrical parts in confrontation at axially opposite ends of the chamber;

means defining a fluid drain conduit from the chamber;

means mounting one of the matable electrical parts in the respective tubular means for axial movement between a retracted position wherein the two matable electrical parts are unmated, and an extended position wherein the two matable electrical parts are mated;

conduit means extending into one of the tubular means behind, the respective matable electrical part; and an opening through the last-mentioned matable electrical part for communicating the last-mentioned tubular means, behind the respective matable electrical part with the chamber for the supply of electrically non-conductive rinsing fluid thereto;

the other of said tubular means being the one surrounding the movably mounted one of the matable electrical parts;

a compression spring being provided, fixed at one end and having the other end bearing against the movably mounted one of the matable electrical parts in such a sense as to tend to mate the two matable electrical parts and to cause the compression spring to be resiliently compressed when the movably mounted one of the matable electrical parts is retracted away from the other of the matable electrical parts;

whereby, electrically non-conductive fluid may be introduced under pressure through said conduit means and said opening, into said chamber and out said drain conduit to flush electrically conductive fluid such as sea water, and debris, from the chamber while retracting the movably mounted one of said matable electrical parts and compressing said spring, and when pressure behind the electrically non-conductive fluid is released, the spring recovers and mates the two matable electrical parts.

12. The wet connector of claim 12, wherein:

the one matable electrical part comprises at least one pin; and the other matable electrical part comprises at least one socket, arranged to axially removably receive the pin.

13. A wet connector, comprising:

two complementary insulated electrical connectors having respective matable electrical parts;

tubular means surrounding the respective electrical parts and having respective circumferential sealing means; the tubular means of one connector being sealingly engageable with the tubular means of the other connector with the aid of said sealing means, irrespective of whether the respective matable electrical parts are mated, to define a generally cylindrical chamber having the respective matable electrical parts in confrontation at axially opposite ends of the chamber;

means defining a fluid drain conduit from the chamber;

means mounting one of the matable electrical parts in the respective tubular means for axial movement between a retracted position wherein the two matable electrical parts are unmated, and an extended position wherein the two matable electrical parts are mated;

conduit means extending into one of the tubular means behind, the respective matable electrical part; and an opening through the last-mentioned matable electrical part for communicating the last-mentioned tubular means, behind the respective matable electrical part with the chamber for the supply of electrically non-conductive rinsing fluid thereto;

a first of said matable electrical parts comprising a socket insert including a body of electrically insulating material having a plurality of sockets of electrically conductive material extending longitudinally therethrough from a forward face thereof to a rear face thereof and arranged in an array of sockets which are spaced transversally from one another;

the fluid drain conduit having a plurality of inlets opening through said forward face radially outside said array of sockets; and said forward face radially, inwardly of the fluid drain conduit inlets being provided with an interface member of elastomeric material bonded thereon, the elastomeric interface member, when uncompressed being convex towards the second of said matable electrical parts and having axial openings therethrough in axial alignment with the respective sockets, whereby this convexity aids in the flow of said electrically nonconductive fluid from the sockets through the chamber and towards the drain conduit inlets as the chamber is being flushed;

said second matable electrical part comprising a body of electrically insulating material having a plurality of pins of electrically conductive material mounted therein and extending axially forwardly of a forward face thereof, the pins being arranged in an array corresponding to the array of sockets so that each pin is axially aligned with a socket;

the elastomeric interface member so closely approaching the forward face of the second matable electrical part when said one matable electrical part is retracted, compared to the length of axial travel of said one matable electrical part when said one matable electrical part is moved from being retracted to being mated with said other matable electrical part, that in the process of mating, the pins pass through the openings in the elastomeric interface member and the elastic interface member is resiliently flattened against the forward face of the second matable electrical part, largely extinguishing the volume of said chamber.

* * * * *